US006945882B2

(12) United States Patent
Strong

(10) Patent No.: US 6,945,882 B2
(45) Date of Patent: Sep. 20, 2005

(54) BASKETBALL TRAINING AND GAME DEVICE

(76) Inventor: Joseph P. Strong, 1913 222nd Ave. NE., Sammamish, WA (US) 98074

( * ) Notice: Subject to any disclaimer, the term of this patent is extended or adjusted under 35 U.S.C. 154(b) by 0 days.

(21) Appl. No.: 10/254,689

(22) Filed: Sep. 24, 2002

(65) Prior Publication Data

US 2003/0060310 A1 Mar. 27, 2003

Related U.S. Application Data

(60) Provisional application No. 60/324,896, filed on Sep. 25, 2001.

(51) Int. Cl.[7] ..... A63B 69/00

(52) U.S. Cl. ..... 473/447; 700/91; 340/323 R

(58) Field of Search ..... 473/447, 422, 473/415; 700/90–92; 235/1 B; 340/574, 323 R; 368/284, 109

(56) References Cited

U.S. PATENT DOCUMENTS 4,220,992 A * 9/1980 Blood et al. ..... 700/91
4,286,323 A * 8/1981 Meday ..... 700/92
4,367,526 A * 1/1983 McGeary et al. ..... 377/5
4,526,479 A 7/1985 Harris
4,637,732 A 1/1987 Jones et al.
4,868,772 A * 9/1989 Collard ..... 700/91
5,084,695 A 1/1992 Freeman
5,153,826 A * 10/1992 Johnson ..... 700/91
5,181,009 A 1/1993 Perona
5,847,652 A * 12/1998 Yamamoto ..... 340/574
5,877,480 A 3/1999 Tuso et al.
6,148,242 A 11/2000 Descalzi et al.

* cited by examiner

*Primary Examiner*—Gregory Vidovich
*Assistant Examiner*—M. Chambers
(74) *Attorney, Agent, or Firm*—Dean A. Craine

(57) ABSTRACT

A portable combination timer/calculator for basketball players and coaches that is used for indicating the elapse of selected time periods and recording the number of attempted baskets, made baskets, and shot percentages. The device includes a belt worn around a player's waist that contains a "made" basket button, and a "missed" basket button, mounted on opposite ends of the belt. Mounted centrally on the belt is an outer housing with a main on/off button, a timer, a calculator, a plurality of programmed timer buttons, and a speaker. Also mounted on the surface of the outer housing is a game select button that enables the device to be used to play various basketball related games or to be used as a recording device for "made" or "missed" baskets. The player presses the "made" or "missed" basket buttons when a shot is made or missed. Also, when the selected time period has elapsed, an audio signal is broadcast through the speaker.

17 Claims, 4 Drawing Sheets

BASKETBALL TRAINING AND GAME DEVICE

This is a utility patent application based on a provisional (Ser. No. 60/324,896) filed on Sep. 25, 2001.

BACKGROUND OF THE INVENTION

1. Field of the Invention

This invention relates to basketball timers and shot counters, and more particularly, to such devices designed to be worn by a player while practicing or playing the game of basketball.

2. Description of the Related Art

It is widely known that basketball players of all ages must spend considerable time practicing to improve their skills, both individually and as a team. When practicing in simulated game situations, individuals and teams must learn to play against the clock. Over time, players intuitively learn the amount of time needed to run a patterned play or to make a particular move.

It is common for coaches to use a hand-held stop clock or a scoreboard clock to measure the amount of time it takes to execute a particular play, or make a particular move. The coach either blows a whistle or activates a scoreboard buzzer when a desired amount of time has elapsed. One drawback is that stop-clocks and scoreboard clocks do not provide an audible countdown. Another drawback with the use of a stop clock or scoreboard clock is that it requires someone other than the player(s) on the court to activate and deactivate. In addition, scoreboards are not always readily available or easily accessible for team practice sessions, and are usually not available to individual players practicing by themselves.

Another key factor to becoming a successful basketball player is the implementation of a training program to improve the player's shooting percentage. It is well known to coaches and players that using contests and setting goals for players is an effective teaching tool. For example, requiring a player to keep track of the number of baskets made or missed within a specific time period, and then comparing the results with the other player's results, or the player's own previous results is a very effective method of training.

It is widely known that basketball players must spend countless hours practicing under simulated game situations to become skilled players. In order to become a skilled player, it is necessary to practice under simulated game situations and learn to play against the clock effectively. The rules of the game impose a variety of time limitations that apply added pressure to players and teams. Over time, skilled players and teams learn intuitively to execute plays or particular moves within a given amount of time.

What is needed is a training device worn by an individual player that enables the player to record baskets made or missed electronically, while allowing the player to maintain his or her shooting rhythm.

What is needed is a basketball timer/shot counter device that can be worn and easily operated by a player practicing by him or herself or with a team of players.

What is also needed is such a device that is programmed with selected, short time periods commonly used in basketball games.

What is also needed is such a device that includes a calculator to accurately compute the number of baskets made or missed baskets and shooting percentages.

What is also needed is such a device that can also be used in an assortment of shooting games specific to basketball.

SUMMARY OF THE INVENTION

It is an object of the present invention to provide a combination timer/shot counter device worn by a player that is programmed with predetermined time periods commonly used in basketball.

It is a second object of the present invention to provide such a device that calculates the number of baskets made or missed and calculates shooting percentages.

It is another object of the present invention to provide such a device that can be worn around the waist and easily operated by the user while playing without affecting the player's shot or movement.

It is a further object to provide such a device that can be used to play basketball shooting games.

These and other objects of the present invention are met by a personal basketball timer/shot counter device comprising an outer housing attached to a belt worn around a player's waist. The device includes a printed circuit board hereinafter known as a PCB, with a built-in timer and calculator that are connected to at least one LED display mounted on the outer housing that displays the amount of remaining time, the total number of baskets made or missed by the player, and shooting percentages. Mounted on the front surface of the outer housing is a plurality of predetermined time interval buttons that enable the user to select different time periods commonly used in basketball, such as 5-second, 10-second, 15-second, 30-second and 45-second intervals. In the preferred embodiment, each time interval button is associated with a unique alphanumeric character which is shown on the LED display or broadcast by the voice synthesizer when activated. Also, mounted on the top surface of the outer housing are buttons used to clear information and calculate the recorded data, respectively.

Connected to the calculator is an optional data storage means that enables the player to record the basketball shooting information for later retrieval.

Mounted near the opposite ends of the belt or the outer housing are basket "made" and basket "missed" buttons that the player quickly touches or slaps with his or her hand to record a "made" or "missed" basket, respectively. In the preferred embodiment, the buttons are mounted on the belt on opposite sides of the outer housing so that the user may easily touch or slap without taking his or her eyes off the floor or hoop.

Located inside the outer housing is a speaker that broadcasts an audio signal when the selected time has elapsed, when the "made" or "missed" buttons are pressed, or the name of the alphanumeric character associated with a selected timer button. An optional voice systhesizer is also provided that provides audible messages, such as "number of seconds remaining", "missed" or "made" basket indication, and "score".

A battery is also located inside the outer housing which produces an electric current to the timer and control circuits, calculator, and LED displays.

DESCRIPTION OF THE PREFERRED EMBODIMENT(S)

Figure 1:
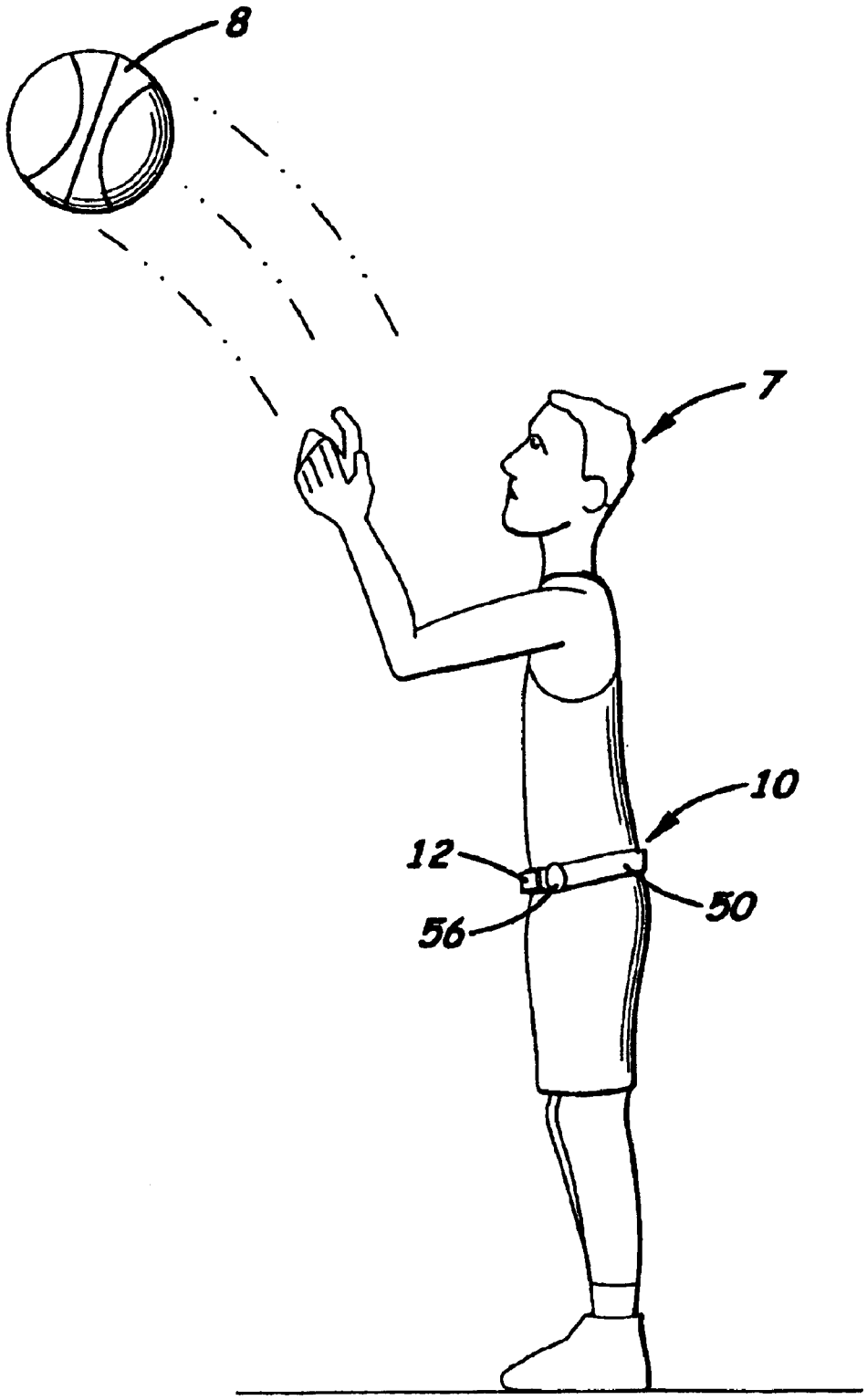
FIG. 1 is perspective view of a basketball player wearing the personal basketball timer/shot counter and shooting baskets.
Figure 2:
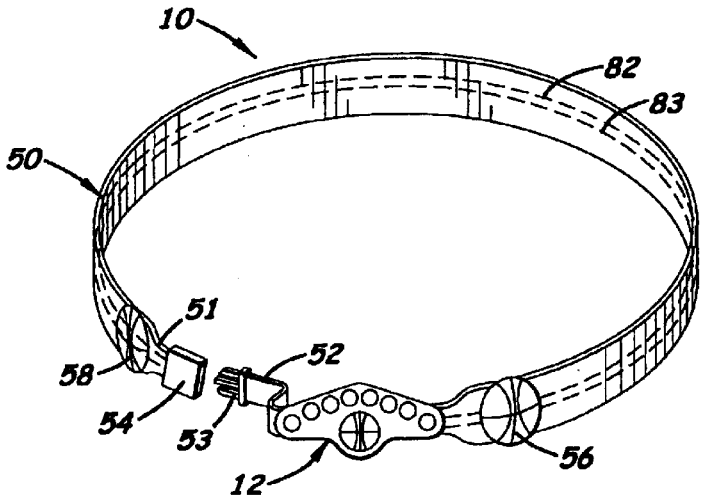
FIG. 2 is a perspective view of the device.

Shown in FIG. 1 is a basketball player 7 wearing the personal basketball timer/shot counter device 10 disclosed herein used while shooting a basketball 8. The device 10 is designed to be lightweight, compact and sufficiently durable so that it may be attached to a belt 50 and worn around the waist of a player 7 while playing. The device 10 includes touch-activated "made" or "missed" basket buttons 56, 58, respectively, that the player may slap to easily record "made" or "missed" baskets while shooting, enabling the player 7 to remain focused on the basketball hoop or court. The device 10 also includes a built-in speaker 75 that broadcasts when the "made" or "missed" basket buttons 56, 58, respectively, are pressed, the amount of time remaining in a selected period, and a time period end signal. The speaker 75 is especially useful because it enables other players to hear whether a shot has been made or missed, or the amount of time remaining without watching a shot clock. In addition, the device 10 also includes a built-in memory storage means so that the shooting records may be saved and retrieved later. The device 10 also includes a game selection button 48 that enables the player 7 to select a variety of basketball shooting games that can be played with other players wearing their own devices 10.

The belt 50 is designed to be securely worn around the player 7 as he or she plays, as shown in FIG. 1. Attached to the distal and proximal ends, 51, 52 respectively, of the belt 50 are male and female couplers, 53, 54 respectively, used to selectively attach the belt 50 around the player 7. Attached to the proximal end 52 of the belt 50 is a small, compact outer housing 12 that has a plurality of timer control buttons 20, 22, 24, 26, 28, 30, 32 and a main ON/OFF switch 42 mounted on its front surface 14. The outer housing 12 is positioned on the belt 50 near the player's midline axis, adjacent to the player's abdomen.

Figure 3:
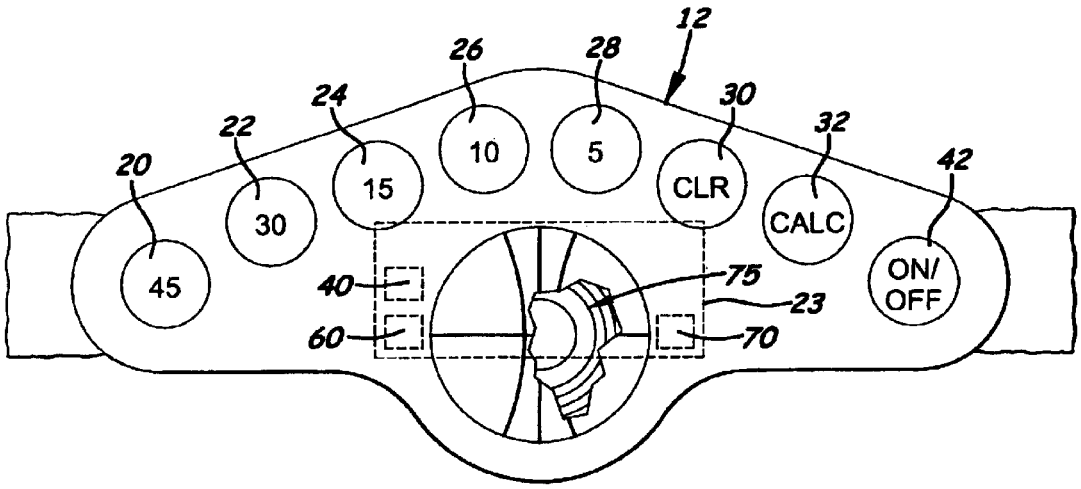
FIG. 3 is a front elevational view of the device.
Figure 4:
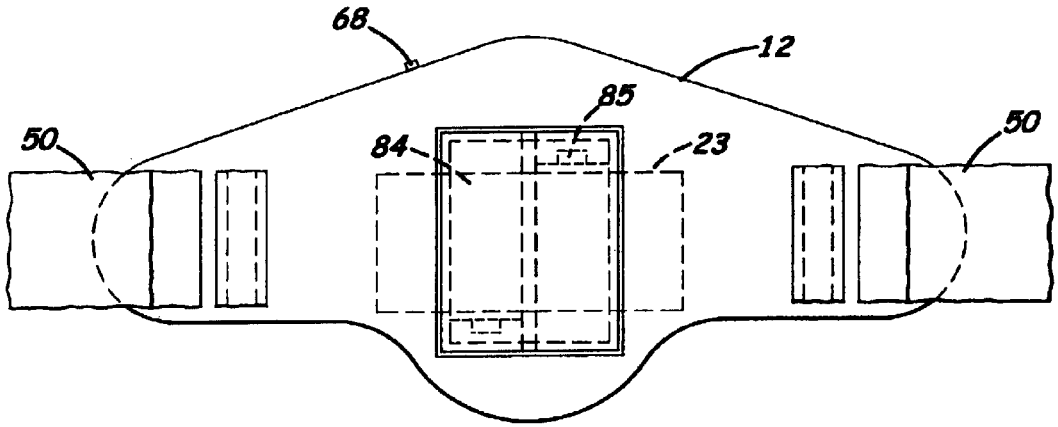
FIG. 4 is a rear plan view of the device.

In the first embodiment, the touch-activated "made" basket button and "missed" basket buttons 56, 58, respectively, are mounted on the outer, opposite sides of the belt 50 that enable the player 7 to quickly tap to record a "made" or "missed" basket. In the preferred embodiment, the "made" basket button 56 is orange and the "missed" basket button 58 is black. Wires 82, 83 extend throughout the belt 50 to connect the buttons 56, 58 to the PCB 23 inside the outer housing 12. In a second embodiment shown in FIGS. 3 and 5, the "made" basket button 56 and "missed" basket button 58 are pre-mounted on the outer housing 12.

Figure 5:
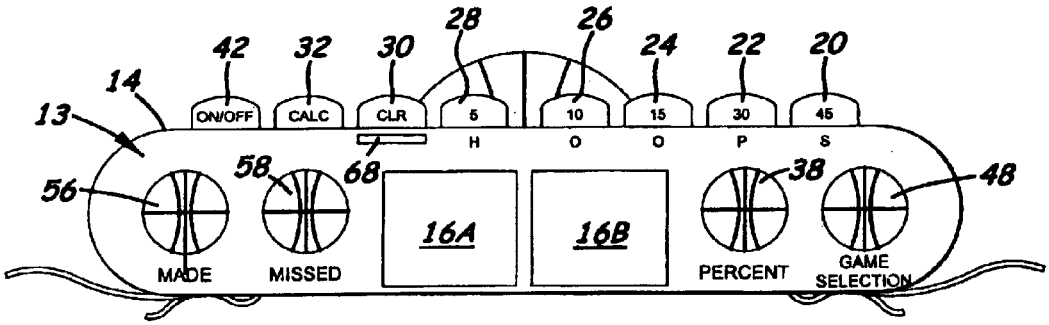
FIG. 5 is a top plan view of the device.

Located inside the outer housing 12 is a printed circuit board 23 (hereinafter referred to as PCB) that includes a built-in timer 40, a calculator 60, and a voice synthesizer 70. Both the timer 40 and calculator 60 are connected to first and second LED displays 16A, 16B, respectively, mounted on the top surface 13 of the outer housing 12 as shown in FIG. 5. The LED displays 16A, 16B visually display the title of the game and the number of shots "made" or "missed" and shooting percentages. The second LED 16B is used to display the number of "made" and "missed" baskets, the time remaining, and shooting percentages. Mounted on the front surface 14 of the outer housing 12 are timer control buttons 20, 22, 24, 26, 28. The timer control buttons 20, 22, 24, 26, 28 are connected to the PCB 23 and timer 40 and enable the user to select forty-five, thirty, fifteen, ten, and five second time intervals, respectively. In the preferred embodiment, each timer control button 20, 22, 24, 26, 28 is associated with an alphanumeric character. When the timer control button 20, 22, 24, 26, 28 is activated, the alphanumeric character associated therewith is displayed on one of the LED displays 16A or 16B. Also mounted on the top surface 13 of the outer housing 12 is a main ON/OFF switch 42 also connected to the PCB 23 that selectively controls the flow of dc electric current from batteries 84, 85 located inside the outer housing 12.

Figure 6:
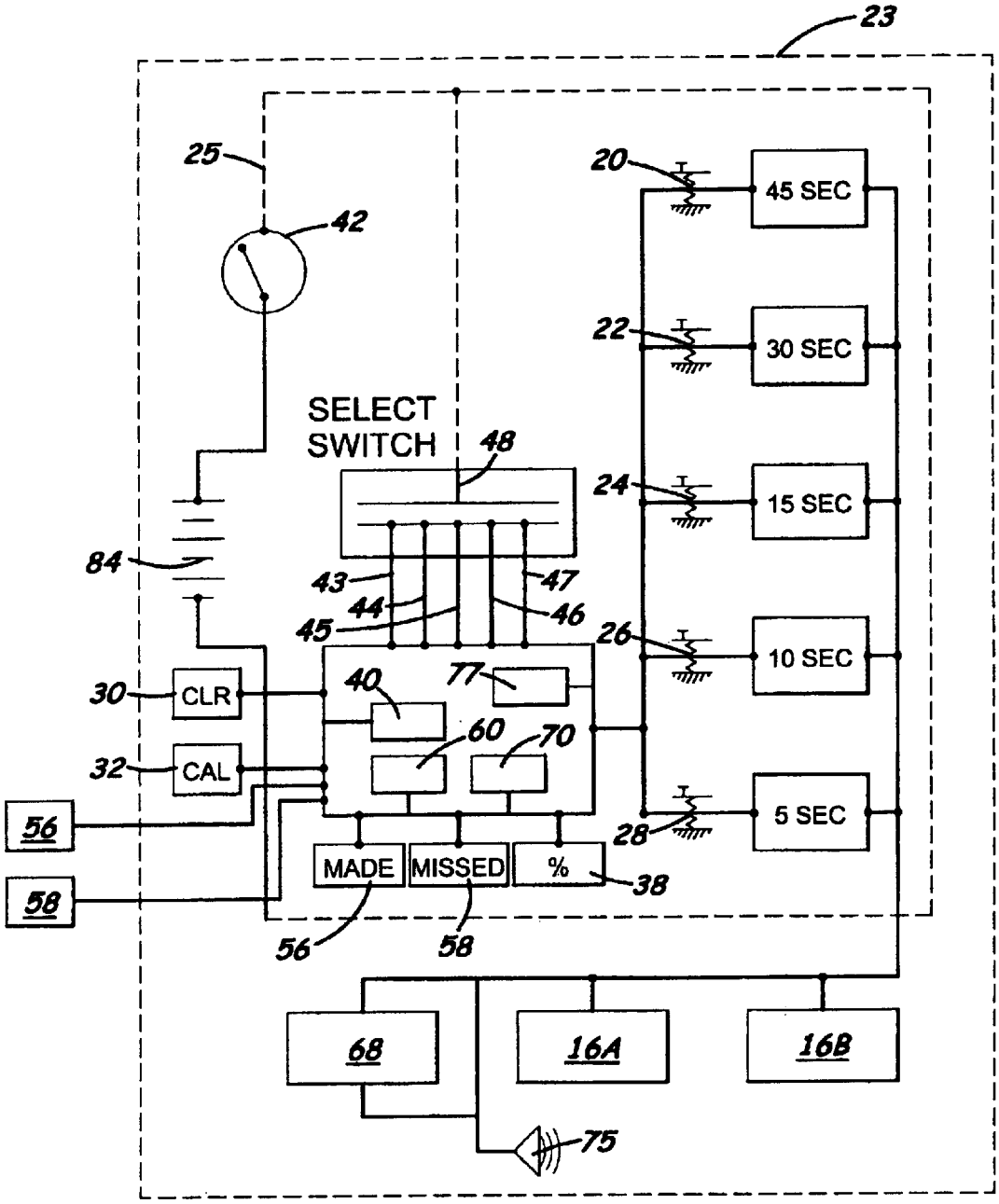
FIG. 6 is a schematic of the electrical components used in the device.

As shown in FIG. 6, printed on the PCB 23 is a main circuit 25 with a speaker 75 connected thereto which broadcasts an audio signal to the players when the selected time interval has elapsed or when the "made" and "missed" basket buttons 56, 58 are slapped. Connected to the main circuit 25 is the calculator 60 that records to record the number of "made" or "missed" baskets and calculate shooting percentages. Mounted on the side surface of the outer housing 12 is an optional volume control button 68 used to control the volume of the audio signal broadcast from the speaker 75. In the preferred embodiment, the speaker 75 is mounted centrally on the top surface 13 of the outer housing 12 and behind a basketball image. Also connected to the PCB 23 is the optional voice synthesizer 70 that is coupled to the timer 40 and speaker 75 to provide a countdown feature for selected time periods.

Mounted on the top surface 13 of the outer housing 12 is a "CALC" button 32 designed to initiate calculation of the recorded basket information stored in the calculator 60 and a "CLR" button 30 designed to clear the information stored in the memory storage means 77. Also mounted on the top surface 13 of the outer housing 12 is a five (5) position game selection button 48 connected to the PCB 23 that enables the device 12 to operate in one of five (5) positions (denoted 43, 44, 45, 46, 47 in FIG. 6) each assigned to one of the five (5) different modes—a Timed or Un-timed Shooting mode; a Best Free Throw Shooting Game mode, a Best Field Goal Shooting mode, a Hoops Shooting Game mode, and a Basketball Game mode.

The five different uses or modes are described as follows.

Timed or Un-Timed Shooting Mode:

In this mode, the device 10 is used for timed or un-timed shooting practice. The player 7 first selects the device 10 and attaches the belt 50 around his or her waist. He or she then activates the device 10 by moving the main ON/OFF switch 42 to the "ON" position. The player then presses the game selection button 48 to select the timed or un-timed Shooting Mode which is displayed on the first LED 16A. Each time a basket is "made" or "missed", the player 7 slaps the proper touch-activated basket button 56, 58, respectively, mounted on the sides of the belt 50 on the top of the outer housing 12 to record the shot results. Each time the "made" or "missed" side button 56, 58 is selected, an audio sound is broadcast from the speaker 75. If the player wants to shoot for a predetermined time interval, one of the time interval buttons 20, 22, 24, 26, 28 may be selected at the beginning of the shooting session. When the time interval has elapsed, an audio end signal is broadcast from the speaker 75. When the player 7 has completed the shooting session, he or she then presses the "CALC" button 32 to determine the total number of shots "made" or "missed" which is then presented on the second LED display 16B. If calculating percentages is desired, the player selects the "PERCENT" button 38. When the shooting session is completed, the player selects the "CLR" button 30 or moves the main ON/OFF switch 42 to the "OFF" position. In addition to being used in competition games, the timed shooting mode may also be used to practice last second shots, 5 second in-bounds drills, 10 second drills to bring the ball past half court, and 30 to 45 second shot clock drills.

Best Free Throw Shooting Mode:

The Best Free Throw Shooting mode can be played by one player or several players. The object of the game is to determine which player makes the most free throws in a predetermined number of shots.

To begin this game, the main switch 42 is moved to the "ON" position and the game selection switch 48 is pressed so that the "Best Free Throwing Shooting" title is displayed in the first LED display 16A. The game begins by double pressing the "made" basket button 56. Each "made" basket or "missed" basket is recorded by pressing the "made" basket button 56 or "missed" basket button 58. When the allotted number of shots has been taken, the game is completed, and the players press the "CALC" button 32 to calculate the total number of shots attempted and "made". The "PERCENT" button 38 is pressed if the shooting percentage is desired.

A new game begins by pressing "CLR" button 30.

Best Field Goal Shooting Mode:

The main switch 42 is moved to the "ON" position and the game selection button 48 is pressed until the "Best Field Goal Shooting" title is displayed in the first LED display 16A. The game begins by double pressing the "made" basket button 56. Each time a basket is made, the "made" basket button 56 is pressed again to record the "made" shot. Each time the basket is "missed', the missed basket button 58 is pressed. To obtain the number of shots "made" or "missed", or shooting percentages, the player selects the "CALC" button 32 or "PERCENT" button 38, respectively which are displayed in the second LED display 16B.

A new game begins by pressing "CLR" button 30.

"HOOPS" Shooting Game:

"HOOPS" Shooting Game is a game designed to help players improve their shooting skills with or without a clock.

The main switch 42 is moved to the "ON" position and the game switch 48 is placed in the "HOOPS GAME" position (not shown). The game title is then displayed in the first LED display 16A. There is an option to play with another player, but in this case each player would be required to wear a device 10. The objective of this game is to eliminate the other player by first making a field goal in hopes that the opponent will miss. If the opponent misses, the opponent is required to push the button corresponding to the first letter in the word "HOOPS." The first player to have all the "HOOPS" buttons depressed is the loser. An audio recording announces "HOOPS" when the final letter "S" is depressed, indicating which player has lost the game.

Basketball Game Mode:

Basketball Game mode is a game designed to assist players in developing their one-on-one skills.

The main switch 42 is pressed to turn the device 10 "ON". The game selection switch 48 is then pressed until the "Basketball Game" is displayed on the first LED display 16A. This is a two-player game, requiring each participant to wear the device 10. Each time a player scores, the player slaps the "made" basket button 56 on the device 10. The players may or may not slap the "missed" basket button 58 each time a shot is missed. The first player to reach the agreed upon game winning score is the victor.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A basketball training and game device, comprising:

a. an outer housing;

b. a printed circuit board mounted inside said outer housing, said printed circuit board including memory capable of storing data;

c. a timer electrically connected to said printed circuit board;

d. a display means connected to said printed circuit board;

e. a plurality of basketball timer buttons connected to said printed circuit board;

f. a calculator connected to said printed circuit board;

g. a battery connected to said printed circuit board;

h. a body attachment means attached to said outer housing for selectively attaching said outer housing to a user;

i. a made basket button connected to said printed circuit board and attached to said body attachment means;

j. a missed basket button connected to said printed circuit board; and, k. an on/off switch connected to said printed circuit board.

2. A basketball training and game device, comprising:

a. an outer housing;

b. a printed circuit board mounted inside said outer housing, said printed circuit board including memory capable of storing data;

c. a timer electrically connected to said printed circuit board;

d. a display means connected to said printed circuit board;

e. a plurality of basketball timer buttons connected to said printed circuit board;

f. a calculator connected to said printed circuit board;

g. a battery connected to said printed circuit board;

h. a body attachment means attached to said outer housing for selectively attaching said outer housing to a user;

i. a made basket button connected to said printed circuit board;

j. a missed basket button connected to said printed circuit board and attached to said body attachment means; and, k. an on/off switch connected to said printed circuit board.

3. The basketball training and game device, as recited in claim 1, wherein said body attachment means is a belt worn around the waist of a user.

4. The basketball training and game device, as recited in claim 2, wherein said body attachment means is a belt worn around the waist of a user.

5. A basketball training and game device, comprising:

a. an outer housing;

b. a printed circuit board mounted inside said outer housing, said printed circuit board including memory capable of storing data;

c. a timer electrically connected to said printed circuit board;

d. a display means connected to said printed circuit board;

e. a plurality of basketball timer buttons connected to said printed circuit board;

f. a calculator connected to said printed circuit board;

g. a battery connected to said printed circuit board;

h. a body attachment means attached to said outer housing for selectively attaching said outer housing to a user said means being a belt worn by said user and said missed basket button and said made basket button are mounted on said belt at opposite sides of said outer housing;

i. a made basket button connected to said printed circuit board;

j. a missed basket button connected to said printed circuit board; and;

k. an on/off switch connected to said printed circuit board.

6. The basketball training and game device, as recited in claim 5, further including a speaker mounted inside said outer housing and electrically connected to said printed circuit board.

7. The basketball training and game device, as recited in claim 6, further including a voice synthesizer connected to said printed circuit board.

8. The basketball training and game device, as recited in claim 5, further including a calculation button connected to said calculator used to display the total number of baskets made or missed on said display means.

9. The basketball training and game device, as recited in claim 8, further including a percentage button connected to said calculator to display the shooting percentages.

10. The basketball training and game device, as recited in claim 9, further including a plurality of game buttons connected to said printed circuit board, each said button being associated with a single alphanumeric element and connected to said display means to display said alphanumeric element thereon.

11. The basketball training and game device, as recited in claim 5, further including a game selection button connected to said printed circuit board, said game selection button being used to select a mode of play from the following group of playing modes—a timed or untimed shooting mode, a best free throw shooting mode best field goal shooting mode, a hoops shooting mode, and a basketball game mode.

12. The basketball training and game device, as recited in claim 11, further including a clear button connected to said printed circuit board used to clear said memory.

13. A basketball training and game device, comprising:

a. an outer housing;

b. a printed circuit board mounted inside said outer housing, said printed circuit board including memory capable of storing data;

c. a timer electrically connected to said printed circuit board;

d. a display means connected to said printed circuit board;

e. a plurality of basketball timer control buttons connected to said printed circuit board, each said timer control button being coupled to said display means and being associated with a single alphanumeric character;

f. a calculator connected to said printed circuit board;

g. a battery connected to said printed circuit board;

h. a belt attached to said outer housing for selectively attaching said outer housing to a user when worn around a user;

i. a made basket button connected to said printed circuit board and attached to said belt on one side of said outer housing;

j. a missed basket button connected to said printed circuit board and attached to said belt on a side opposite said made basket button;

k. an on/off switch connected to said printed circuit board, and;

l. a game selection button connected to said printed circuit board, said game selection button used to select a mode of play from the following group of playing modes—a timed or untimed shooting mode, a best free throw shooting mode, a best field goal shooting mode, a hoops shooting mode, and a basketball game mode.

14. The basketball training and game device, as recited in claim 13, further including a speaker mounted inside said outer housing and electrically connected to said printed circuit board.

15. The basketball training and game device, as recited in claim 14, further including a voice synthesizing means.

16. The basketball training and game device, as recited in claim 15, further including a calculation button connected to said calculator used to display the total number of baskets made or missed on said display means.

17. The basketball training and game device, as recited in claim 16, further including a percentage button connected to said calculator to display the shooting percentages.

* * * * *

UNITED STATES PATENT AND TRADEMARK OFFICE

CERTIFICATE OF CORRECTION

PATENT NO. : 6,945,882 B2
DATED : September 20, 2005
INVENTOR(S) : Joseph P. Strong It is certified that error appears in the above-identified patent and that said Letters Patent is hereby corrected as shown below:

Column 2,
Line 45, insert -- the buttons -- after “slap” and before “without”.
Line 51, replace “systhesizer” with -- synthesizer --.
Lines 65, 66 and 67, replace “device” with -- outer housing --.

Column 4,
Line 51, insert -- 13 -- after “top” and before “of”.

Signed and Sealed this

Sixth Day of December, 2005

JON W. DUDAS
*Director of the United States Patent and Trademark Office*